US009040878B2

(12) United States Patent
Castellano Aldave et al.

(10) Patent No.: US 9,040,878 B2
(45) Date of Patent: May 26, 2015

(54) CONTROL SYSTEM AND METHOD FOR A THERMAL CIRCUIT

(75) Inventors: Jesús Carlos Castellano Aldave, Pamplona (ES); Francisco Javier Tornaria Iguelz, Pamplona (ES)

(73) Assignee: GESTION ENERGETICA NAVARRA, S.L. (ES)

( * ) Notice: Subject to any disclaimer, the term of this patent is extended or adjusted under 35 U.S.C. 154(b) by 348 days.

(21) Appl. No.: 13/580,824

(22) PCT Filed: Feb. 17, 2011

(86) PCT No.: PCT/IB2011/000297

§ 371 (c)(1),
(2), (4) Date: Aug. 23, 2012

(87) PCT Pub. No.: WO2011/104595

PCT Pub. Date: Sep. 1, 2011

(65) Prior Publication Data

US 2012/0325802 A1 Dec. 27, 2012

(30) Foreign Application Priority Data

Feb. 26, 2010 (EP) ..... 10380024

(51) Int. Cl.
*H05B 1/02* (2006.01)
*F24D 19/10* (2006.01)

(52) U.S. Cl.
CPC ..... *F24D 19/1015* (2013.01); *F24H 2240/08* (2013.01)

(58) Field of Classification Search
CPC H05B 2203/121; H05B 1/02; F24H 2240/08; F24D 2200/16; F24D 19/1015
USPC ..... 219/482, 488, 494, 209, 210, 439; 392/308, 311, 441, 478, 449, 496; 236/1 C, 50
See application file for complete search history.

(56) References Cited

U.S. PATENT DOCUMENTS 2,363,168 A * 11/1944 Findley ..... 126/110 E
4,157,034 A * 6/1979 Buchele ..... 374/41
4,412,647 A 11/1983 Lampert
4,629,115 A * 12/1986 Lampert et al. ..... 236/36
5,779,141 A * 7/1998 Okumura et al. ..... 236/36

(Continued)

FOREIGN PATENT DOCUMENTS

DE 103008021697 A1 5/2009
EP 0018566 A1 11/1980

(Continued)

*Primary Examiner* — Mark Paschall
(74) *Attorney, Agent, or Firm* — Hess Patent Law Firm; Robert J Hsss

(57) ABSTRACT

A control system and method for a thermal circuit that includes a control unit (1) and a valvular device which regulate the passage of a heat transfer fluid (6) through the inside of a thermal circuit, and a thermoelectric element (3) powering the control unit (1) from the heat of the heat transfer fluid (6).

The control unit (1) and/or the valvular device are configured to regulate the circulation of the heat transfer fluid (6) through the inside of the thermal circuit, in order to always maintain a sufficient minimum flow to assure, at all times, the electric power supply of the control unit (1).

The method includes using a control system to carry out regulation of the circulation of the heat transfer fluid which assures the electric power supply of part or the entire control system.

18 Claims, 1 Drawing Sheet

(56) References Cited

U.S. PATENT DOCUMENTS

| | | | | |
|---|---|---|---|---|
| 6,334,311 | B1 * | 1/2002 | Kim et al. | 62/3.2 |
| 6,571,564 | B2 * | 6/2003 | Upadhye et al. | 62/3.3 |
| 8,720,388 | B2 * | 5/2014 | Beyerle et al. | 122/20 B |
| 2004/0211845 | A1 | 10/2004 | Chain | |
| 2007/0017223 | A1 * | 1/2007 | Wootton et al. | 60/645 |
| 2011/0005562 | A1 * | 1/2011 | Bisges | 136/206 |
| 2014/0130935 | A1 * | 5/2014 | Lugtigheid | 141/1 |

FOREIGN PATENT DOCUMENTS

| | | | |
|---|---|---|---|
| EP | 0152906 | A1 | 8/1985 |
| EP | 0717332 | A1 | 6/1996 |
| GB | 2301667 | A | 12/1996 |

* cited by examiner

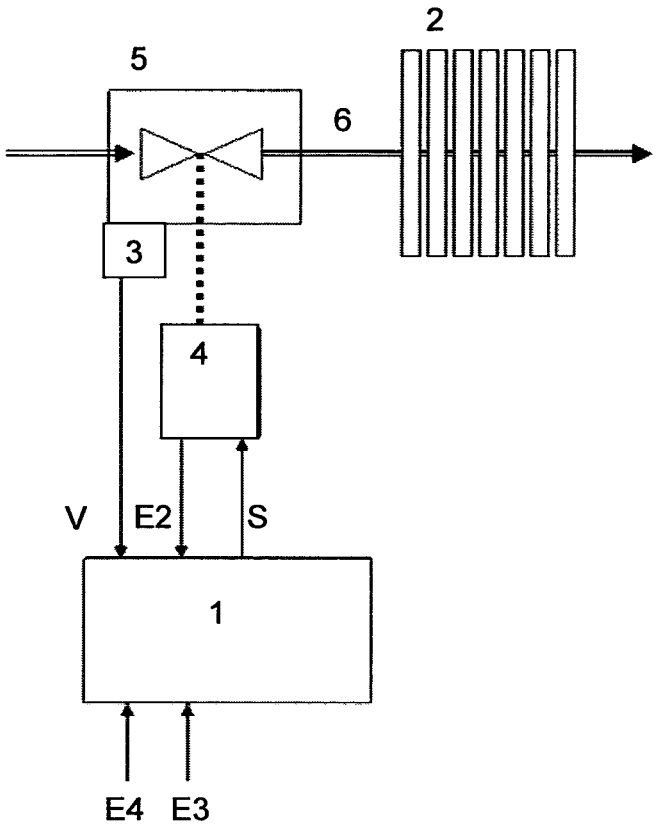
2
5
6
3
4
V
E2
S
1
E4
E3

CONTROL SYSTEM AND METHOD FOR A THERMAL CIRCUIT

FIELD OF THE ART

The present invention relates, in a first aspect, to a control system for a thermal circuit comprising a control unit powered by a thermoelectric element arranged to generate electricity from the heat of a heat transfer fluid circulating through said thermal circuit, and more particularly to a control system provided to control the circulation of said heat transfer fluid for the purpose of assuring, at all times, the electric power supply of the control unit.

A second aspect of the invention relates to a control method for a thermal circuit which comprises using a control system like the one proposed by the first aspect of the invention.

The invention is particularly applicable to the control of heating circuits.

PRIOR STATE OF THE ART

Control systems for thermal circuits, particularly heating circuits, which are powered by means of electric energy generated from the thermal energy of such thermal circuits, are known.

Patent EP0152906B1 discloses one of such control systems. In particular, said patent relates to an arrangement for measuring the amount of heat radiated by a heating element and for simultaneously controlling the flow of a heat transfer fluid circulating through the inside of said heating element, for the purpose of regulating the temperature of the room where the heating element is located.

For some embodiments described in EP0152906B1, the use of active thermal elements, such as Peltier elements, for powering the electronic circuitry of the control system from the thermal energy of the heat transfer fluid is contemplated.

Patent EP0018566B1 describes an apparatus for controlling the flow of a fluid, such as hot water or steam, of a central heating system, in one or more areas in which the supplied heat is controlled individually. The apparatus proposed in EP0018566B1 is also provided for measuring values of, for example, temperature of said fluid.

Various embodiments are proposed for which the apparatus proposed in EP0018566B1 includes active elements, such as Peltier elements, which, from the heat energy of the fluid in question, generate electric energy with which to power the electronic circuitry included in the apparatus for performing the mentioned flow control and value measurement.

None of said background documents describes or suggests not turning off the respective heaters completely, i.e., interrupting the flow of heat transfer fluid through the inside of the heaters, once a desired temperature has been reached. When such situation occurs, the supply of electric energy from the Peltier elements is also interrupted, therefore, although storing said energy in corresponding accumulators is proposed, when the latter have been discharged after a sufficient time of absence of circulation of the heat transfer fluid, the electronic circuitry which was powered by them either stops working, or must be powered from an alternative power source, therefore the exclusive power supply from the Peltier elements is not assured in the apparatuses proposed in EP0152906B1 and EP0018566B1.

Although both background documents propose controlling a thermal circuit, in particular the flow of a heat transfer fluid circulating through the inside of one or more heating elements, the purpose of such control is to regulate the emission temperature of the heating elements.

Said patents neither indicate nor suggest performing the mentioned control of the flow of the heat transfer fluid for the purpose of assuring the mentioned electric power supply from the Peltier elements, even in the cases in which the heating remains turned off for long time periods.

Therefore, both background documents share the objective problem of suffering from not having a control method or apparatus for a thermal circuit which, in addition to the purpose of regulating the temperature emitted by same, has as objective assuring the power supply of a series of electronic elements for controlling such thermal circuit, at all times.

EP 0717332A1 discloses a control system for a thermal circuit comprising an electrical actuator control used with an electrical actuator mechanism for controlling the flow of fluid through a valve in a central heating system. The control system of this invention differs from the one of EP 0717332A1 in that the control unit and/or the valvular device are configured to regulate the circulation of said heat transfer fluid through the inside of the radiating body or bodies, in order to always maintain a sufficient minimum flow for said thermoelectric element to generate electricity, from which the electric power supply or at least said part of the control unit can be assured at all times.

DESCRIPTION OF THE INVENTION

The present invention provides a solution to the objective problem indicated above, which allows the control of the thermal circuit to have the two mentioned objectives: that of regulating temperature and that of assuring the electric power supply of the electronic circuitry used.

To that end, the present invention relates, in a first aspect, to a control system for a thermal circuit which comprises, in a manner known in itself, at least one control unit and, in connection with said thermal circuit, a valvular device, connected to one another and cooperating in the regulation of the passage of a heat transfer fluid through the inside of one or more hollow radiating bodies comprised by said thermal circuit, and said control system furthermore comprising at least one thermoelectric element arranged to generate electricity from the heat of said heat transfer fluid, to power part or the entire control unit from the generated electricity.

Unlike conventional proposals, and in a characteristic manner, in the control system proposed by the first aspect of the invention the control unit and/or the valvular device are configured to regulate the circulation of the heat transfer fluid through the inside of said hollow radiating body or bodies, in order to always maintain a sufficient minimum flow for the thermoelectric element to generate electricity, from which the electric power supply of part or the entire the control unit can be assured at all times.

For one embodiment, the control system comprises a voltage boosting circuit with its input in connection with the output of said thermoelectric element or elements to raise the voltage with which to power the control unit, for the purpose of assuring it at all times, although the output voltage of the thermoelectric elements is low.

For another embodiment alternative or complementary to the one of the previous paragraph, the control system comprises at least one electric energy storage element arranged to store the electric energy generated by thermoelectric element or elements.

In relation to the thermoelectric element, it comprises, for one embodiment, one or more Seebeck cells with a first face arranged to reach or come close to the temperature of the heat transfer fluid and a second face arranged to reach or come close to the ambient temperature, in order to generate an electric current proportional to the temperature difference between the faces thereof.

Depending on the embodiment, the first face of said Seebeck cell or cells is in contact with an area of the outer face of an inlet pipe for heat transfer fluid, in particular adjacent to an inlet valve of said hollow radiating body comprised by the valvular device, or in contact with the body of said valve or another valve.

The control system proposed by the first aspect of the invention is applied, for a preferred embodiment, to the control of heating circuits, said hollow radiating body being a heating radiator.

For a variant of said embodiment, the control system is applied to a central heating system, the control system being provided to control the circulation of the heat transfer fluid circulating through several radiators, maintaining said minimum flow.

A second aspect of the invention relates to a control method for a thermal circuit which comprises, in a manner known in itself, using a control system powered, at least partly, by means of electric energy generated from the heat energy of a heat transfer fluid circulating through the inside of said thermal circuit.

Unlike the conventional proposals mentioned in the state of the art section, where the control of the thermal circuit was performed only for the purpose of regulating the emitted temperature, the control method proposed by the second aspect of the invention comprises, in a characteristic manner, regulating the circulation of said heat transfer fluid through the inside of said thermal circuit, in order to always maintain a sufficient minimum flow for generating sufficient electric energy to assure, at all times, the electric power supply of at least part of the control system.

For one embodiment, the method is applied to the control of heating circuits formed by one or more heating radiators, either as part of an individual heating system or, alternatively, of a central heating system, in which case the method comprises controlling the circulation of the heat transfer fluid circulating through several heaters of the central heating system, always maintaining said minimum flow through the inside of all of them to assure, at all times, the electric power supply of at least part of all the control systems included in the heating system.

In relation to the so-called minimum flow, the method comprises, for one embodiment, selecting it to heat each heating radiator to a temperature equal to or below substantially 1% of the one marked by its maximum heat capacity, for a certain heat transfer fluid which is at a certain temperature.

According to one embodiment, the method is implemented by the control system proposed by the first aspect of the invention.

BRIEF DESCRIPTION OF THE DRAWINGS

The previous and other advantages and features will be more fully understood from the following detailed description of several embodiments with reference to the attached drawing, which must be taken in an illustrative and non-limiting manner, in which:

FIG. 1 is a schematic depiction of the control system proposed by the first aspect of the invention, for an embodiment for which it is applied to a thermal circuit including a heater.

DETAILED DESCRIPTION OF SOME EMBODIMENTS

With reference to FIG. 1, it shows the control system proposed by the first aspect of the invention, for an embodiment for which it comprises a drive servomotor 4 in connection with the mentioned control unit 1 and with a servovalve 5 comprised by the aforementioned valvular device, to operate the servovalve 5 under the command of the control unit 1.

Although the thermoelectric element 3 has been schematically shown by means of a block 3 directly connected to the power supply input V of the control unit 1, said block 3 will generally include or be connected to the aforementioned voltage boosting circuit (not shown) and, optionally, to a corresponding electric energy storage element, for the purpose of using the excess electric energy generated in high heat emission periods.

It can be seen in said FIG. 1 how the control unit 1 is bidirectionally connected with the drive servomotor 4, through respective input E2 and output S, for the purpose of sending to it, through S, the corresponding electric control signals for regulating the opening/closing of the servovalve 5, and for the purpose of receiving, through E2, information about the actual opening position of the servovalve 5, acquired by means of corresponding detection means (not shown) associated with the servomotor 4.

The heat transfer fluid 6 has been schematically shown in FIG. 1 by means of a line with an arrow indicating the direction of circulation thereof which, as can be seen in said FIG. 1, traverses the servovalve 5 and after it passes through the heater 2.

The control unit 1 has other inputs, indicated as E3 and E4, through which it receives information of other operating parameters of the thermal circuit, or of the environment thereof (such as the temperature of the room where it is located), and implements a control algorithm processing all the received signals and acts accordingly, proportionally opening or closing the servovalve 5 regulating the flow of heat transfer fluid 6.

For one embodiment, the control unit 1 is configured to, by means of sending a corresponding partial closing signal to the drive servomotor 4, make the servovalve 5 adopt and remain in a partially closed position which allows only the mentioned minimum flow of heat transfer fluid 6 to pass therethrough. In this case, the servovalve 5 is capable of closing completely if the drive servomotor 4 receives a command or electric signal with a certain magnitude, therefore it is the control unit 1 which, by means of sending a partial closing signal or electric signal with a magnitude less than the complete closing signal, makes the drive servomotor 4 act on the servovalve 5 so that it adopts said partial closing position. In other words, it is the control unit 1 which regulates the passage of heat transfer fluid 6 to always maintain the minimum flow indicated above.

For another alternative embodiment, the servovalve 5 is configured to adopt a partially closed position which only allows the minimum flow of heat transfer fluid 6 to pass therethrough, when the drive servomotor 4 receives a complete closing signal by the control unit 1, i.e., an electric signal with the mentioned certain magnitude for the complete closing. In other words, for this embodiment, the regulation of the passage of the mentioned minimum flow of heat transfer fluid 6 is carried out by the servovalve 5 itself, because although the control unit 1 sends a complete closing control signal to the drive servomotor 4 and the latter acts on the servovalve 5 so that it adopts such complete closing position, such servovalve will not "obey" and will not close completely, but rather will remain slightly open to allow the passage of said minimum flow.

For one variant of said embodiment, such regulation is carried out by means of arranging a stop element (not shown)

inside the passage section of the servovalve 5, which prevents the latter from closing completely, i.e., from closing beyond said partially closed position.

It is necessary to emphasize that the maintenance at all times of the mentioned minimum flow circulating through the heaters has other advantages additional to those mentioned, such as that of requiring, when it is necessary to heat the heaters of a heating system, a much quicker initial heating phase than in conventional heating systems which must make the heat transfer fluid, which was static inside the thermal circuit, circulate again and occasionally heat it again.

A person skilled in the art will be able to introduce changes and modifications in the embodiments described without departing from the scope of the invention as it is defined in the attached claims.

The invention claimed is:

1. A control system for a thermal circuit, comprising:

a valvular device in connection with said thermal circuit, such that said valvular device and at least one hollow radiating body of the thermal circuit are in fluidic communication with each other, said valvular device and said thermal circuit cooperate in the regulation of the passage of a heat transfer fluid through the inside of said at least one hollow radiating body, at least one control unit arranged for controlling the opening/closing of said valvular device through corresponding electric command signals, at least one thermoelectric element arranged in thermal contact with the heat transfer fluid to generate electricity from the heat of said heat transfer fluid, and electrically connected with said control unit to electrically power supply at least part of said control unit from the generated electricity, wherein said control unit and said valvular device are configured to regulate the circulation of said heat transfer fluid through the inside of said at least one hollow radiating body, by making the valvular device adopt a partially closed position which allows only a sufficient minimum flow of the heat transfer fluid to pass therethrough and through the at least one hollow radiating body, in order to always maintain the sufficient minimum flow of heat transfer fluid for said thermoelectric element to always generate electricity, from which the electric power supply of at least said part of the control unit electrically power supplied by the at least one thermoelectric element is assured at all times.

2. The control system according to claim 1, wherein said thermoelectric element comprises at least one Seebeck cell with a first face arranged to reach or come close to the temperature of the heat transfer fluid and a second face arranged to reach or come close to the ambient temperature in order to generate an electric current proportional to the temperature difference between the faces thereof.

3. The control system according to claim 2, wherein said first face of said at least one Seebeck cell is in contact with an area of the outer face of an inlet pipe for heat transfer fluid, of said hollow radiating body.

4. The control system according to claim 3, wherein said area of the outer face of said inlet pipe is adjacent to an inlet valve of said hollow radiating body.

5. The control system according to claim 2, wherein said first face of said at least one Seebeck cell is in contact with the body of at least one valve comprised by said valvular device.

6. The control system according to claim 1, further comprising a drive servomotor in electrical connection with said control unit and in mechanical connection with a servovalve comprised by said valvular device, to operate said servovalve under the command of said control unit through the sending, by said control unit, of an electric command signal to said drive servomotor which makes said servovalve adopt said partially closed position which allows only said minimum flow of heat transfer fluid (6) to pass therethrough.

7. The control system according to claim 6, wherein said servovalve is configured to adopt a partially closed position which only allows said minimum flow of heat transfer fluid to pass therethrough, when said drive servomotor receives a partial closing signal by said control unit, wherein said control unit is configured to send a corresponding partial closing signal to said drive servomotor to make said servovalve adopt and remain in said partially closed position which allows only said minimum flow of heat transfer fluid to pass therethrough.

8. The control system according to claim 6, wherein said servovalve is configured to adopt a partially closed position which only allows said minimum flow of heat transfer fluid to pass therethrough, when said drive servomotor receives a complete closing signal by said control unit, wherein said control unit is configured to send said complete closing signal to said drive servomotor to make said servovalve adopt said partially closed position.

9. The control system according to claim 8, wherein said servovalve comprises a stop element which prevents it from closing beyond said partially closed position.

10. The control system according to claim 1, further comprising a voltage boosting circuit with its input in connection with the output of said at least one thermoelectric element, to raise the voltage with which to power the control unit.

11. The control system according to claim 1, further comprising at least one electric energy storage element arranged to store the electric energy generated by said at least one thermoelectric element.

12. The control system according to claim 1, wherein the thermal circuit includes heating circuits, said hollow radiating body being a heating radiator.

13. The control system according to claim 12, wherein the heating circuits are part of a central heating system, the control unit controlling the circulation of the heat transfer fluid circulating through several heating radiators of said central heating system, maintaining said minimum flow of heat transfer fluid to pass through each of said heating radiators.

14. The control system according to claim 6, wherein the control unit is electrically and bidirectionally connected with the drive servomotor through:

an input for receiving information about the actual opening position of the servovalve, acquired by means of corresponding detection means associated with the servomotor, and an output for sending to the servomotor the corresponding electric control signals for regulating the opening/closing of the servovalve.

15. The control system according to claim 1, comprising said thermal circuit.

16. A control method for a thermal circuit, comprising:

electrically power supplying, at least partly, at least part of a control unit by means of electric energy thermoelectrically generated from heat energy of a heat transfer fluid circulating through the inside of at least one hollow radiating body of said thermal circuit, regulating circulation of said heat transfer fluid through the inside of said thermal circuit, in order to always maintain a sufficient minimum flow of said heat transfer fluid through the inside of said hollow radiating body of said thermal circuit, for thermoelectrically generating sufficient electric energy to assure, at all times, the electric power supply of said at least part of the control unit, wherein said regulating is performed by controlling, by means of said control unit, a valvular device in fluidic communication with said at least one hollow radiating body to make the valvular device adopt a partially closed position which allows only said sufficient minimum flow of the heat transfer fluid to pass therethrough and through the at least one hollow radiating body, in order to always maintain said sufficient minimum flow of heat transfer fluid.

17. The method according to claim 16, further comprising controlling heating circuits of said thermal circuit, which are formed by at least one heating radiator.

18. The method according to claim 17, further comprising controlling heating circuits of a central heating system, and controlling circulation of the heat transfer fluid circulating through several heating radiators of said central heating system, always maintaining said minimum flow through the inside of all of them to assure, at all times, the electric power supply of at least part of said at least one control unit.

* * * * *